US010544980B2

(12) United States Patent
Fei et al.

(10) Patent No.: US 10,544,980 B2
(45) Date of Patent: Jan. 28, 2020

(54) BRANCHING AIR SUPPLY DEVICE AND REFRIGERATOR WITH SAME

(71) Applicant: QINGDAO HAIER JOINT STOCK CO., LTD, Qingdao (CN)

(72) Inventors: Bin Fei, Qingdao (CN); Xueli Cheng, Qingdao (CN); Xuan Ji, Qingdao (CN); Jinlin Liu, Qingdao (CN)

(73) Assignee: QINGDAO HAIER JOINT STOCK COL, LTD, Qingdao (CN)

( * ) Notice: Subject to any disclaimer, the term of this patent is extended or adjusted under 35 U.S.C. 154(b) by 0 days.

(21) Appl. No.: 15/771,646

(22) PCT Filed: Jun. 8, 2016

(86) PCT No.: PCT/CN2016/085348
§ 371 (c)(1),
(2) Date: Apr. 27, 2018

(87) PCT Pub. No.: WO2017/071232
PCT Pub. Date: May 4, 2017

(65) Prior Publication Data

US 2018/0306483 A1 Oct. 25, 2018

(30) Foreign Application Priority Data

Oct. 29, 2015 (CN) ..... 2015 1 0718727

(51) Int. Cl.
*A47J 47/00* (2006.01)
*F25D 17/06* (2006.01)
*F25D 17/04* (2006.01)

(52) U.S. Cl.
CPC ..... *F25D 17/065* (2013.01); *F25D 17/045* (2013.01)

(58) Field of Classification Search
CPC ..... B60H 1/3421; B60H 1/345; B60H 2001/00707; B60H 2001/00721
(Continued)

(56) References Cited

U.S. PATENT DOCUMENTS 5,076,070 A 12/1991 Takushima et al.
6,029,470 A * 2/2000 Joo ..... F24F 13/075 62/408

(Continued)

FOREIGN PATENT DOCUMENTS

CN 1213765 A 4/1999
CN 1215827 A 5/1999

(Continued)

OTHER PUBLICATIONS

International Search Report and Written Opinion for corresponding International Application No. PCT/CN2016/085348, dated Sep. 13, 2016, 12 pages.

(Continued)

*Primary Examiner* — Vivek K Shirsat
(74) *Attorney, Agent, or Firm* — Alston & Bird

(57) ABSTRACT

Provided are a branching air supply device and a refrigerator with the branching air supply device. The branching air supply device comprises a housing, a plurality of airflow passages provided in parallel being defined in the housing; a plurality of baffle plates, each baffle plate being movably mounted to the housing and being configured to perform complete blocking, partial conducting or complete conducting of one airflow passage in different positions; and a linkage device movably mounted to the housing and configured to move each of the baffle plates intermittently when the linkage device moves. The branching air supply device and the refrigerator can perform uniform adjustment for cooling air, according to cold requirements for different (Continued)

storage compartments or cold requirements for different positions of one storage compartment.

13 Claims, 6 Drawing Sheets

(58) Field of Classification Search
USPC ..... 454/184, 266, 277–281, 309–327
See application file for complete search history.

(56) References Cited

U.S. PATENT DOCUMENTS

| | | | |
|---|---|---|---|
| 6,073,458 | A | 6/2000 | Kim |
| 2010/0107670 | A1 | 5/2010 | Kottke et al. |

FOREIGN PATENT DOCUMENTS

| | | | |
|---|---|---|---|
| CN | 102564011 | A | 7/2012 |
| CN | 102226621 | B | 4/2013 |
| CN | 103175365 | A | 6/2013 |
| CN | 104534780 | A | 4/2015 |
| CN | 102564011 | B | 9/2015 |
| CN | 104879994 | A | 9/2015 |
| DE | 4008012 | A1 | 9/2014 |
| EP | 1175586 | B1 | 6/2006 |
| EP | 2339275 | A2 | 6/2011 |
| EP | 2527766 | A1 | 11/2012 |
| JP | H1172280 | A | 3/1999 |
| JP | 2005321140 | A | 11/2005 |
| JP | 2009097649 | A | 5/2009 |
| JP | 2014035096 | A | 2/2014 |
| WO | WO 00/65289 | | 11/2000 |
| WO | WO 2015089365 | A2 | 6/2015 |

OTHER PUBLICATIONS

Office Action for corresponding Chinese Application No. 201510718727.8 dated Aug. 21, 2017 with English translation, 7 pages.

Search Report for corresponding Chinese Application No. 201510718727.8 dated Aug. 10, 2017, 2 pages.

* cited by examiner

BRANCHING AIR SUPPLY DEVICE AND REFRIGERATOR WITH SAME

CROSS-REFERENCE TO RELATED APPLICATIONS

This application is a national phase entry of International Application No. PCT/CN2016/085348, filed Jun. 8, 2016, which claims priority to Chinese Application No. 201510718727.8, filed Oct. 29, 2015, the entire contents of which are incorporated herein by reference.

TECHNICAL FIELD

The present invention relates to a refrigerating device, and particularly to a branching air supply device and a refrigerator with the branching air supply device.

BACKGROUND OF THE INVENTION

In recent years, with the improvement of people's living standards and enhancement of environmental awareness, the requirements for refrigerators have gradually changed from satisfaction with low-temperature refrigeration to the performance of keeping food fresh. For an air-cooled refrigerator, the performance of keeping food fresh largely depends on airflow circulation within storage compartments of the air-cooled refrigerator and a temperature difference between different parts within the refrigerator. If the airflow circulation within the refrigerator is reasonable, the smaller the temperature difference is, the better the refrigerator's performance of keeping food fresh is. Meanwhile, a key component to determine whether the airflow circulation within the refrigerator is reasonable is an air duct, which controls the air direction and the flow rate magnitude of the refrigerator and directly determines the refrigeration and freshness preservation effects of the refrigerator. Further, in order to optimize storage spaces, a single storage compaitment may generally be separated into a plurality of subdivided storage spaces by shelving devices such as shelves or drawers, and according to the amount of stored articles, the refrigerating capacity required for each of the storage spaces also varies. If cold air directly enters the interior of the storage compartment from a certain place of the storage compartment without control, it may cause the problem that some of the storage spaces are overcooled and some suffer from an insufficient refrigerating capacity.

At present, in the design of a wind path of the air-cooled refrigerator on the market, an evaporator is arranged within an individual accommodation chamber, the accommodation chamber of the evaporator is communicated to each storage compartment with a complex air duct system, and cold air generated by the evaporator is transported to each storage compartment with a draught fan. A control device (such as a single damper, a double damper, and an electric damper) is arranged within the air duct to control the opening and closing of the air duct in communication with each storage compartment or regulate the amount of air entering each storage compartment. However, this kind of structure is relatively complex and is inconvenient to be controlled uniformly, the costs are relatively high, and the control status is relatively single.

In addition, in the existing air-cooled refrigerator, for a multi-path air supply (for example, in a multi-door refrigerator, two temperature-changing chambers in a refrigerating chamber, and a separate ice-making chamber are provided, which requires 3-path, 4-path or 5-path air supply) structure that requires three or more wind paths, multiple dampers are required to be controlled separately, resulting in the refrigerator large in volume and complex in structure.

SUMMARY OF THE INVENTION

The purpose of a first aspect of the present invention is intended to overcome at least one defect of the existing air-cooled refrigerator and provide a branching air supply device for a refrigerator, which has a simple structure and is able to facilitate the uniform regulation of flow paths and flow rate of cold air.

The purpose of a second aspect of the present invention is to provide a refrigerator with the branching air supply device above.

According to the first aspect of the present invention, the present invention provides a branching air supply device, which comprises:

a housing, with a plurality of airflow passages arranged in parallel being defined in the housing;

a plurality of baffle plates, each of the baffle plates being movably mounted to the housing and being configured to perform complete blocking, partial conducting or complete conducting of one of the airflow passages in different positions; and a linkage device movably mounted to the housing and configured to enable each of the baffle plates to move intermittently when the linkage device moves, in order to enable each of the baffle plates to move or keep still during the movement of the linkage device from one position to another, and to enable each of the baffle plates to move or keep still when the other, one or more of the baffle plates move, so that each of the baffle plates adjusts the flow rate of airflow in one of the airflow passages.

Optionally, each of the baffle plates is rotatably mounted in one of the airflow passages; or each of the baffle plates is movably mounted to the housing in a direction perpendicular to the airflow passages.

Optionally, the linkage device comprises a plurality of sliders synchronously moving in a direction parallel to the airflow passages; each of the sliders extends in the direction parallel to the airflow passages, and has a concave-convex surface extending in a bent manner in the direction parallel to the airflow passages; and each of the baffle plates is in contact with the concave-convex surface of one of the sliders, such that when each of the sliders moves, under the curved surface change of the concave-convex surface of the slider, one of the baffle plates rotates intermittently or moves in the direction perpendicular to the airflow passages.

Optionally, the housing comprises a base, and a plurality of parallel-arranged air duct walls extending from one surface of the base, every two adjacent air duct walls that are closest to each other defining one of the airflow passages therebetween.

Optionally, the housing also comprises an air duct cover mounted to an end of the plurality of air duct walls that is away from the base; and each of the baffle plates is rotatably mounted to the air duct cover.

Optionally, the air duct wall on at least one side of each of the airflow passages is provided with a sliding groove extending in a lengthwise direction of the air duct wall and a guide slot extending in a thickness direction of the air duct wall, each of the sliding grooves having an opening which faces away from the base, and each of the guide slot communicating the sliding groove and the airflow passage, and each of the sliders is movably mounted into the sliding groove of one of the air duct walls; and each of the baffle plates comprises a convex column which is inserted into the guide slot of one of the air duct walls and is in contact with the concave-convex surface of the slider located in the sliding groove of the air duct wall.

Optionally, each of the baffle plates also comprises a baffle plate portion and a connecting plate portion which extends from one surface of the baffle plate portion and is perpendicular to the baffle plate portion, and the convex column of each of the baffle plates protrudes from the connecting plate portion of the baffle plate.

Optionally, the linkage device also comprises two linkage rods respectively fixed to two ends of the plurality of sliders such that the plurality of sliders synchronously move.

Optionally, the branching air supply device also comprises:

a rack extending in the direction parallel to the airflow passages and fixedly connected to or integrally formed with the outermost one of the sliders;

a gear meshing with the rack; and a driving device configured to drive the gear to rotate.

Optionally, the branching air supply device also comprises:

a plurality of elastic members, each of the elastic members being configured to urge one of the baffle plates to come into contact with and abut against the concave-convex surface of one of the sliders.

Optionally, each of the baffle plates, when in contact with a concave surface of the concave-convex surface, is configured to completely block one of the airflow passages; and each of the baffle plates, when in contact with a convex surface of the concave-convex surface, is configured to completely conduct one of the airflow passages.

Optionally, the plurality of airflow passages comprise a first airflow passage, two second airflow passages located on two sides of the first airflow passage, and two outermost third airflow passages; and the plurality of sliders comprise a first slider, two second sliders located on two sides of the first slider, and two outermost third sliders;

a concave-convex surface of the first slider is convex, concave, convex and concave in a flow direction of airflow in the airflow passages;

a concave-convex surface of each of the second sliders is concave, convex, concave and convex in the flow direction of airflow in the airflow passages; and a concave-convex surface of each of the third sliders is convex and concave in the flow direction of airflow in the airflow passages.

Optionally, the plurality of airflow passages are symmetrically arranged about a geometric symmetry plane, and the linkage device is also configured to enable the baffle plates in every two of the airflow passages that are symmetrical about the geometric symmetry plane to synchronously move.

According to the second aspect of the present invention, the present invention provides a refrigerator, which comprises:

an air duct assembly with a main air supply duct and a plurality of branch air ducts being defined in the air duct assembly, wherein the plurality of branch air ducts are configured such that the airflow flowing out of the air duct assembly enters a plurality of storage compartments of the refrigerator, respectively, or the airflow flowing out of the air duct assembly enters the storage compartment from a plurality of positions on a compartment wall of one storage compartment of the refrigerator, respectively; and any of the branching air supply devices mentioned above that is provided in the air duct assembly, inlets of a plurality of airflow passages of the branching air supply device being all in communication with the main air supply duct, and outlets of the plurality of airflow passages being respectively in communication with the plurality of branch air ducts.

According to the second aspect of the present invention, the present invention also provides a further refrigerator, which comprises:

an air duct assembly, with an air supply passage being defined in the air duct assembly; and any of the branching air supply devices mentioned above that is provided in the air supply passage and configured to regulate the flow rate of the airflow flowing through the air supply passage.

Since the branching air supply device and the refrigerator of the present invention comprise a plurality of airflow passages, and each of the baffle plates is enabled to intermittently move by a linkage device to controllably block or conduct the plurality of airflow passages so as to realize the selection of branch air ducts, and/or to regulate the flow rate of airflow in each of the airflow passages, cold air may be uniformly regulated and distributed reasonably according to refrigerating capacity requirements for different storage compartments or refrigerating capacity requirements at different positions in one storage compartment, thus increasing the freshness preservation performance and running efficiency of the refrigerator.

Further, the branching air supply device of the present invention has a simple, compact structure and a small size, and can be conveniently installed in the air duct assembly. In addition, the special structure of the linkage device can make it easy to control the refrigerator, can realize the selection of the branch air ducts, and/or the regulation of the flow rate of the airflow in each of the airflow passages only through the control of the movement of the linkage device.

According to the detailed description of particular embodiments of the present invention below in conjunction with the accompanying drawings, the above and other purposes, advantages and features of the present invention will become more apparent for a person skilled in the art.

BRIEF DESCRIPTION OF THE DRAWINGS

Some of particular embodiments of the present invention will be described below in detail in an exemplary but not limiting way with reference to the accompanying drawings. The same reference signs indicate the same or similar components or parts in the accompanying drawings. It is understood by a person skilled in the art that the accompanying drawings are not necessarily drawn to scale. In the accompanying drawings.

DETAILED DESCRIPTION OF THE INVENTION

Figure 1:
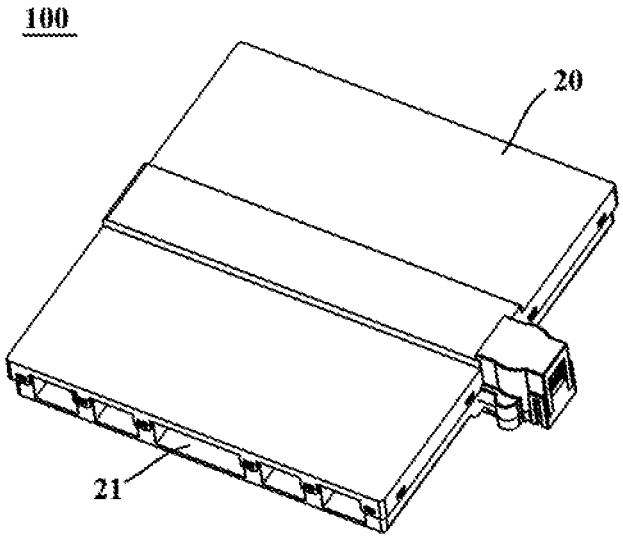
FIG. 1 is a schematic structural diagram of a branching air supply device according to one embodiment of the present invention.
Figure 2:
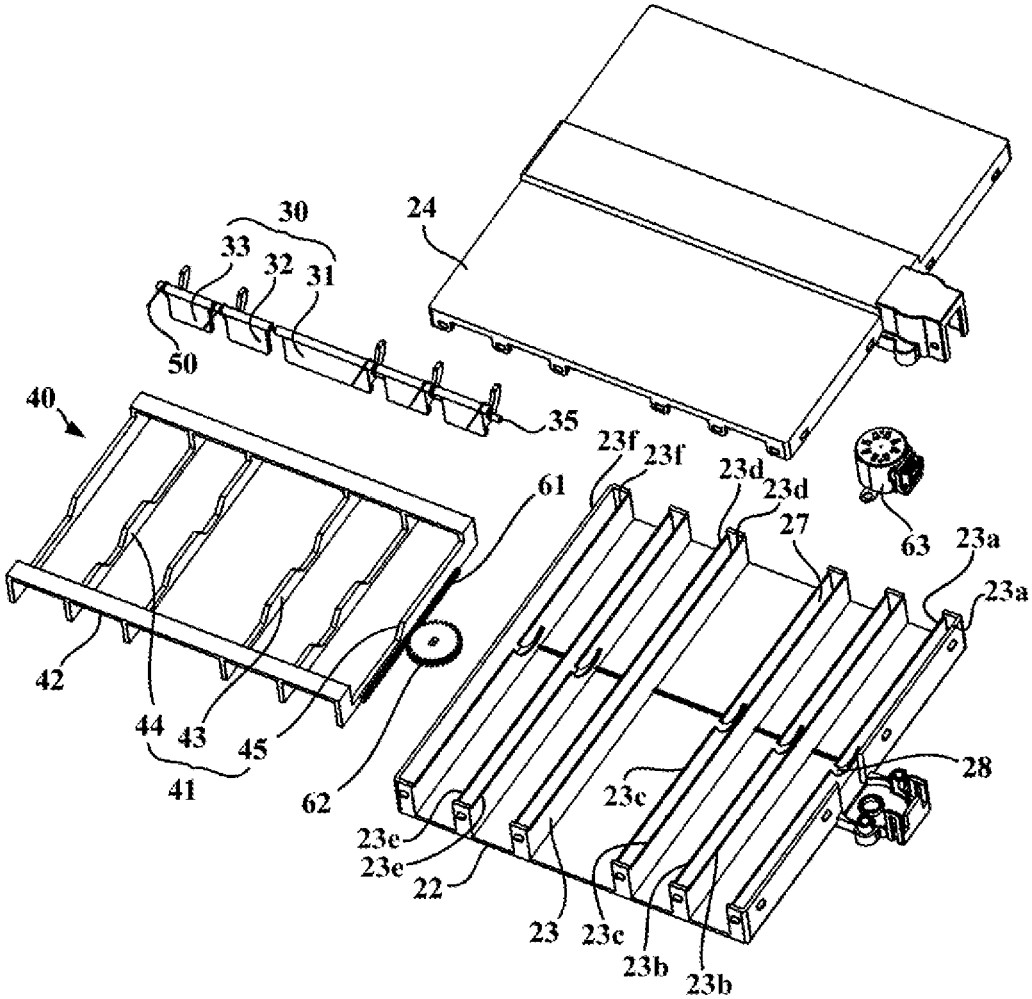
FIG. 2 is a schematic exploded view of the branching air supply device according to one embodiment of the present invention.

FIG. 1 is a schematic structural diagram of a branching air supply device 100 according to one embodiment of the present invention; and FIG. 2 is a schematic exploded view of the branching air supply device 100 according to one embodiment of the present invention. As shown in FIG. 1 and FIG. 2, embodiments of the present invention provide a branching air supply device 100. The branching air supply device 100 may comprise a housing 20, a plurality of baffle plates 30 and a linkage device 40. A plurality of airflow passages 21 arranged in parallel are defined in the housing 20, each of the airflow passages 21 having an inlet and an outlet. Each of the baffle plates 30 is movably mounted to the housing 20 and is configured to perform complete blocking, partial conducting or complete conducting of one of the airflow passages 21 in different positions. For example, each of the baffle plates 30 is rotatably mounted in one of the airflow passages 21; or each of the baffle plates 30 is movably mounted to the housing 20 in a direction perpendicular to the airflow passages 21.

The linkage device 40 is movably mounted to the housing 20. In particular, the linkage device 40 is configured to enable each of the baffle plates 30 to move intermittently when the linkage device moves, in order to enable each of the baffle plates 30 to move or keep still during the movement of the linkage device from one position to another, and to enable each of the baffle plates 30 to move or keep still when the other, one or more of the baffle plates 30 move, so that each of the baffle plates 30 adjusts the flow rate of airflow in one of the airflow passages 21.

For example, in some embodiments, three airflow passages 21 can be defined in the housing 20, and are respectively a first airflow passage, a second airflow passage, and a third airflow passage. The number of the baffle plates 30 can be three, and a first baffle plate 31, a second baffle plate 32 and a third baffle plate 33 are respectively provided and are respectively rotatably mounted in the three airflow passages 21. When the linkage device 40 is in an initial position, the three baffle plates 30 can completely conduct the three airflow passages 21. During the movement of the linkage device 40 from the initial position to a first position, the first baffle plate 31 can move and move to the movement position that completely blocks the first airflow passage; the second baffle plate 32 can move and move to the movement position that partially conducts the second airflow passage; and the third baffle plate 33 can keep still. During the movement of the linkage device 40 from the first position to a second position, the first baffle plate 31 can move and move to the movement position that partially conducts the first airflow passage; the second baffle plate 32 can keep still to be in the movement position that partially conducts the second airflow passage; and the third baffle plate 33 can move and move to the movement position that completely blocks the third airflow passage.

The linkage device 40 of the branching air supply device 100 according to the embodiments of the present invention enables a plurality of baffle plates 30 to respectively adjust the flow rate of airflow in one of the airflow passages 21 so as to controllably distribute cold air entering the airflow passage, making it possible to control the opening and closing of branch air ducts 320 in communication with each of the airflow passages 21 and/or to regulate the air outlet amount in each of the branch air ducts 320, and then meeting refrigerating capacity requirements for different storage compartments or refrigerating capacity requirements at different positions in one storage compartment or refrigerating capacity requirements for different storage spaces in one storage compartment.

In some embodiments of the present invention, the linkage device 40 comprises a plurality of sliders 41 synchronously moving in a direction parallel to the airflow passages 21. Each of the sliders 41 extends in the direction parallel to the airflow passages 21, and has a concave-convex surface extending in a bent manner in the direction parallel to the airflow passages 21. Each of the baffle plates 30 is in contact with the concave-convex surface of one of the sliders 41, such that when each of the sliders 41 moves, under the curved surface change of the concave-convex surface of the slider, one of the baffle plates 30 rotates intermittently or moves in the direction perpendicular to the airflow passages 21. The branching air supply device 100 according to the embodiments of the present invention can also comprise a plurality of elastic members 50, each of the elastic members 50 being configured to urge one of the baffle plates 30 to come into contact with and abut against the concave-convex surface of one of the sliders 41. For example, each of the elastic members 50 can be a torsion spring.

Further, each concave-convex surface can have at least one concave surface and at least one convex surface. Each of the baffle plates 30, when in contact with a convex surface of the concave-convex surface, is configured to completely conduct one of the airflow passages 21. Each of the baffle plates 30, when in contact with a deepest concave surface of the concave-convex surface, is configured to completely block one of the airflow passages 21. Each of the baffle plates 30, when in contact with a concave surface of the concave-convex surface that has a certain depth, is configured to partially conduct one of the airflow passages 21.

Particularly, in some embodiments, each of the baffle plates 30 is rotatably mounted in one of the airflow passages 21. The branching air supply device 100 can be provided in a vertical direction such that each of the airflow passages 21 extends in the vertical direction. Each of the baffle plates 30 can rotate around the rear end thereof. Each of the sliders 41 can be mounted to a front side wall of one of the airflow passages 21, and the concave-convex surface thereof faces towards the rear. The front end of each of the baffle plates 30 is in contact with the concave-convex surface of one of the sliders 41. When the slider 41 moves in the vertical direction, the other end of the baffle plate 30 can move back and forth in a horizontal direction with the surface curve of the concave-convex surface, and under the action of the axis of rotation of the baffle plate 30, the baffle plate 30 rotates from a horizontal position to an inclined position or a vertical position, or rotates from the inclined position to the horizontal position or the vertical position, or rotates from the vertical position to the inclined position or the horizontal position, thus the baffle plate 30 completely blocks the airflow passage 21 in the horizontal position, partially conducts the airflow passage 21 in the inclined position, and completely conducts the airflow passage 21 in the vertical position.

In some other embodiments of the present invention, each of the baffle plates 30 also comprises a baffle plate portion and a connecting plate portion which extends from one surface of the baffle plate portion and is perpendicular to the baffle plate portion, and a convex column 35 in contact with the concave-convex surface of one of the sliders 41. The convex column 35 of each of the baffle plates 30 protrudes from the connecting plate portion of the baffle plate 30. In this embodiment, when each of the sliders 41 moves, under the curved surface change of the concave-convex surface of the slider, the convex column 35 of one of the baffle plates 30 intermittently moves and then the baffle plate 30 intermittently moves.

In some alternative embodiments of the present invention, when each of the baffle plates 30 is rotatably mounted in one of the airflow passages 21, the linkage device 40 can comprise a plurality of crank and rocker mechanisms and a plurality of gear sets. Each of the crank and rocker mechanisms drives one of the baffle plates 30 to swing, such that one of the airflow passages 21 is completely blocked, partially conducted or completely conducted in different rotation positions. Each of the gear sets comprises a driving wheel and a driven wheel fixed to a crank shaft of one crank rocker, and the driving wheel and the driven wheel form an incomplete gear mechanism, such that the driven wheel rotates intermittently and then drives the each of the baffle plates 30 to rotate intermittently via the crank and rocker mechanisms. One drive motor and a linkage shaft can be used to drive a plurality of driving wheels to synchronously rotate.

In some alternative embodiments of the present invention, when each of the baffle plates 30 is movably mounted to the housing 20 in the direction perpendicular to the airflow passage 21, the linkage device 40 can comprise a plurality of cams, and each of the cams is configured to enable one of the baffle plates 30 to move intermittently in the direction perpendicular to the airflow passage 21. Further, the linkage device 40 can also comprise a linkage shaft, and one drive motor and the linkage shaft can be used to drive the plurality of cams to synchronously rotate.

In some embodiments of the present invention, as shown in FIG. 2, the housing 20 comprises a base 22, and a plurality of parallel-arranged air duct walls 23 extending from one surface of the base 22, every two adjacent air duct walls £23*a*, 23*b*, 23*c*, 23*d*, 23*e*, 23*f*) that are closest to each other defining one of the airflow passages 21 therebetween. Further, the housing 20 of the branching air supply device 100 also comprises an air duct cover 24 mounted to the end of the plurality of air duct walls 23 that is away from the base 22.

Each of the baffle plates 30 is rotatably mounted to the air duct cover 24, and each of the sliders 41 can be slidably mounted to the base 22 or the air duct wall 23. Particularly, the air duct wall 23 on at least one side of each of the airflow passages 21 is provided with a sliding groove 27 extending in a lengthwise direction of the air duct wall and a guide slot 28 extending in a thickness direction of the air duct wall, each of the sliding grooves having an opening which faces away from the base 22, and each of the guide slot communicating the sliding groove 27 and the air flow passage 21. Each of the sliders 41 is movably mounted into the sliding groove 27 of one of the air duct walls 23. A convex column 35 of each of the baffle plates 30 is inserted into the guide slot 28 of one of the air duct walls 23 and is in contact with the concave-convex surface of the slider 41 located in the sliding groove 27 of the air duct wall 23. The guide slot 28 is a circular arc slot, and the guide slot 28 is configured such that, when each of the baffle plates 30 is in the completely-conducted airflow passage 21 or a partially-conducted airflow passage 21, the end away from the axis of rotation thereof is in the downstream of the flow direction of airflow to reduce the resistance to airflow.

In some embodiments of the present invention, the linkage device 40 also comprises two linkage rods 42 respectively fixed to two ends of the plurality of sliders 41 such that the plurality of sliders 41 synchronously move. Each of the linkage rods 42 is on an outer side of the end of the plurality of air duct walls 23 that is away from the base 22, so as to prevent the air duct walls 23 from hindering the movement of the linkage rods 42. Further, the branching air supply device 100 also comprises a driving assembly configured to drive a plurality of sliders 41 to move in the direction parallel to the airflow passages 21. Particularly, the driving assembly can comprise a rack 61, a gear 62 and a driving device 63. The rack 61 extends in the direction parallel to the airflow passages 21 and is fixedly connected to or integrally formed with the outermost one of the sliders 41. The driving device 63 can be a stepping motor configured to drive the gear 62 to rotate. The gear 62 can be mounted to an output shaft of the stepping motor and meshes with the rack 61. Each of teeth of the rack 61 can protrude in the direction parallel to the axis of rotation of the baffle plate 30, so that the stepping motor is located on one side of the air duct wall 23, thereby reducing the thickness of the whole branching air supply device 100. Further, two ends of the slider 41 provided with the rack 61 can also be provided with positioning protrusions to define a stroke of the plurality of sliders 41 moving in the direction parallel to the airflow passage 21.

In some embodiments of the present invention, the plurality of airflow passages 21 are symmetrically arranged about a geometric symmetry plane, and the linkage device 40 is also configured to enable the baffle plates 30 in every two of the airflow passages 21 that are symmetrical about the geometric symmetry plane to synchronously move, in order to synchronize the flow rate of airflow in the two airflow passages 21, thus better air supply can be achieved. For example, the plurality of airflow passages 21 comprise a first airflow passage, two second airflow passages located on two sides of the first airflow passage, and two outermost third airflow passages. The first airflow passage can be used to send air to two lateral sides of an upper part of one storage compartment, the two second airflow passages can be used to send air to the two lateral sides of a middle part of the storage compartment, and the two third airflow passages can be used to send air to two lateral sides of a lower part of the storage compartment, so that the upper part, middle part, and lower part of the storage compartment are uniformly cooled and the air ducts do not cross.

Figure 3:
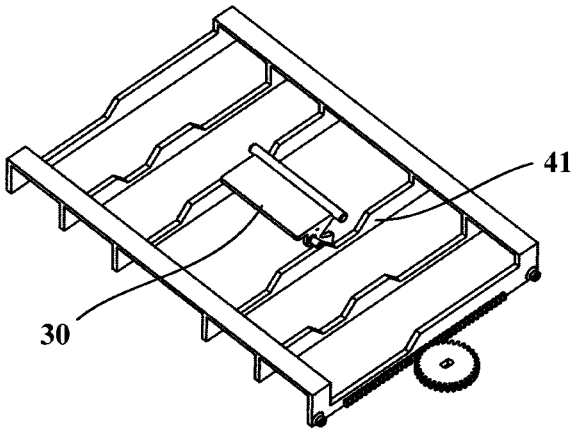
FIG. 3 is a schematic partial structural diagram of the branching air supply device according to one embodiment of the present invention.
Figure 4:
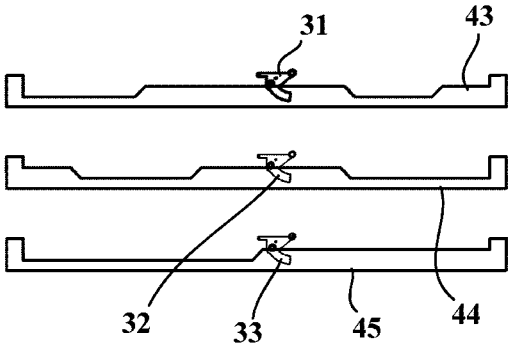
FIGS. 4-11 respectively show schematic partial structural diagrams of the position of each of baffle plates when a linkage device in the branching air supply device is in different positions according to embodiments of the present invention.
Figure 5:
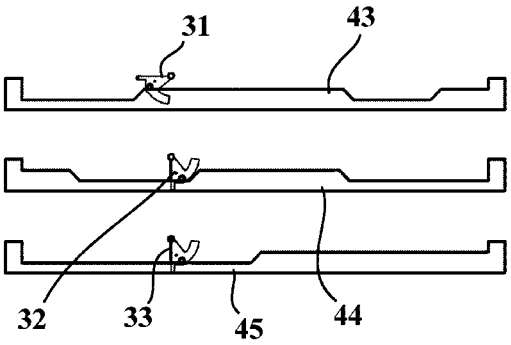
Figure 6:
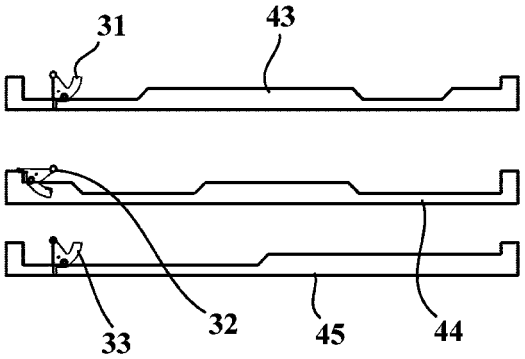
Figure 7:
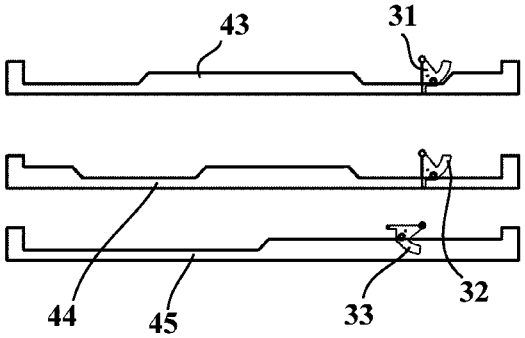

In some embodiments of the present invention, the number of the airflow passages 21, the baffle plates 30 and the sliders 41 can all be five. The plurality of airflow passages 21 comprise a first airflow passage, two second airflow passages located on two sides of the first airflow passage, and two outermost third airflow passages. The plurality of baffle plates 30 comprise a first baffle plate 31 located in the first airflow passage, two second baffle plates 32 respectively located in the two second airflow passages, and two third baffle plates 33 respectively located in the two third airflow passages. The plurality of sliders 41 comprise a first slider 43, two second sliders 44 located on two sides of the first slider 43, and two outermost third sliders 45. A concave-convex surface of the first slider 43 is convex, concave, convex and concave in a flow direction of airflow in the airflow passages 21. A concave-convex surface of each of the second sliders 44 is concave, convex, concave and convex in the flow direction of airflow in the airflow passages 21. A concave-convex surface of each of the third sliders 45 is convex and concave in the flow direction of airflow in the airflow passages 21. In this embodiment, as shown in FIG. 3, each of the baffle plates 30 only has two rotation positions, so as to completely block and completely conduct one of the airflow passages 21. That is to say, each of the baffle plates 30, when in contact with a concave surface of the concave-convex surface, is configured to completely block one of the airflow passages 21. Each of the baffle plates 30, when in contact with a convex surface of the concave-convex surface, is configured to completely conduct one of the airflow passages 21.

FIGS. 4-11 respectively show schematic partial structural diagrams of the position of each of baffle plates 30 when the linkage device 40 in the branching air supply device 100 is in different positions according to embodiments of the present invention, and in the figures, the position of the linkage device 40 is determined to be changed by taking the axis of rotation of each of the baffle plates 30 as a reference. When the linkage device 40 moves to the position shown in FIG. 4, the first baffle plate 31, the second baffle plate 32 and the third baffle plate 33 respectively come into contact with the convex surface of each of the first slider 43, the second slider 44 and the third slider 45, so that the first airflow passage, the second airflow passage and the third airflow passage are all in a completely conducted state. When the linkage device 40 moves to the position shown in FIG. 5, the first baffle plate 31 comes into contact with the convex surface of the first slider 43, and the second baffle plate 32 and the third baffle plate 33 respectively come into contact with the concave surface of either of the second slider 44 and the third slider 45, so that the first airflow passage is in a completely conducted state, and the second airflow passage and the third airflow passage are both in a completely blocked state. When the linkage device 40 moves to the position shown in FIG. 6, the second baffle plate 32 comes into contact with the convex surface of the second slider 44, and the first baffle plate 31 and the third baffle plate 33 respectively come into contact with the concave surface of either of the first slider 43 and the third slider 45, so that the second airflow passage is in a completely conducted state, and the first airflow passage and the third airflow passage are both in a completely blocked state. When the linkage device 40 moves to the position shown in FIG. 7, the third baffle plate 33 comes into contact with the convex surface of the third slider 45, and the first baffle plate 31 and the second baffle plate 32 respectively come into contact with the concave surface of either of the first slider 43 and the second slider 44, so that the third airflow passage is in a completely conducted state, and the first airflow passage and the second airflow passage are both in a completely blocked state.

Figure 8:
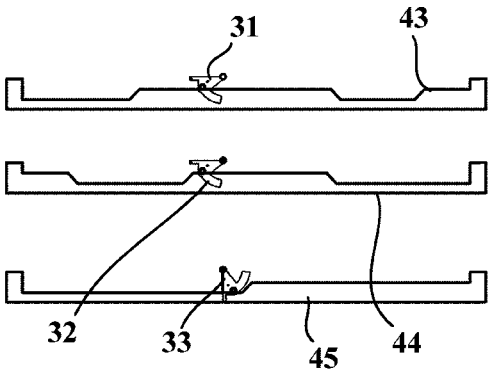
Figure 9:
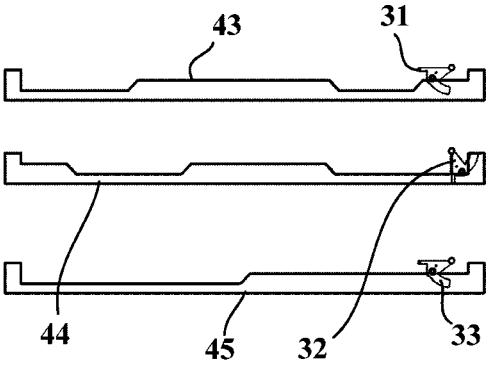
Figure 10:
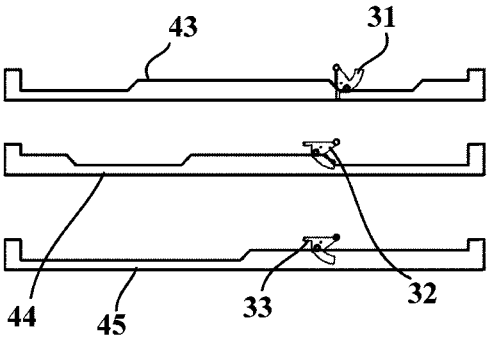
Figure 11:
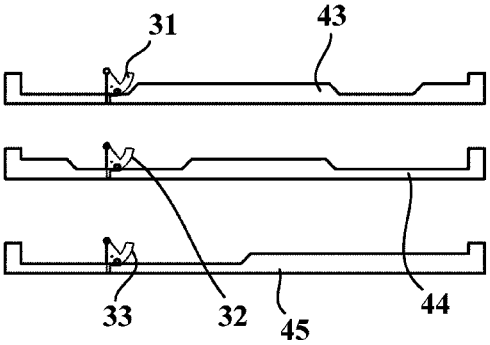

When the linkage device 40 moves to the position shown in FIG. 8, the first baffle plate 31 and the second baffle plate 32 respectively come into contact with the convex surface of either of the first slider 43 and the second slider 44, and the third baffle plate 33 comes into contact with the concave surface of the third slider 45, so that the first airflow passage and the second airflow passage are both in a completely conducted state, and the third airflow passage is in a completely blocked state. When the linkage device 40 moves to the position shown in FIG. 9, the first baffle plate 31 and the third baffle plate 33 respectively come into contact with the convex surface of either of the first slider 43 and the third slider 45, and the second baffle plate 32 comes into contact with the concave surface of the second slider 44, so that the first airflow passage and the third airflow passage are both in a completely conducted state, and the second airflow passage is in a completely blocked state. When the linkage device 40 moves to the position shown in FIG. 10, the first baffle plate 31 comes into contact with the concave surface of the first slider 43, and the second baffle plate 32 and the third baffle plate 33 respectively come into contact with the convex surface of either of the second slider 44 and the third slider 45, so that the first airflow passage is in a completely blocked state, and the second airflow passage and the third airflow passage are both in a completely conducted state. When the linkage device 40 moves to the position shown in FIG. 11, the first baffle plate 31, the second baffle plate 32 and the third baffle plate 33 respectively come into contact with the concave surface of each of the first slider 43, the second slider 44 and the third slider 45, so that the first airflow passage, the second airflow passage and the third airflow passage are all in a completely blocked state.

Embodiments of the present invention also provide a refrigerator, which is provided with one or more storage compartments, and each of the storage compartments can also be divided into a plurality of storage spaces by plates or shelves. Further, the refrigerator is also provided with an air duct assembly 300 and a branching air supply device 100 of any one of the above-mentioned embodiments that is arranged in the air duct assembly 300. A main air supply duct 310 and a plurality of branch air ducts 320 are defined in the air duct assembly 300. The main air supply duct 310 can be in communication with a cooling chamber to receive airflow cooled by a cooler in the cooling chamber. Each of the branch air ducts 320 has one or more cold air outlets. In addition, the plurality of branch air ducts 320 are configured such that air flowing out of the air duct assembly 300 enters a plurality of storage compartments of the refrigerator, respectively. Inlets of the plurality of airflow passages 21 of the branching air supply device 100 are all in communication with the main air supply duct 310, and outlets of the plurality of airflow passages 21 are respectively in communication with the plurality of branch air ducts 320.

Figure 12:
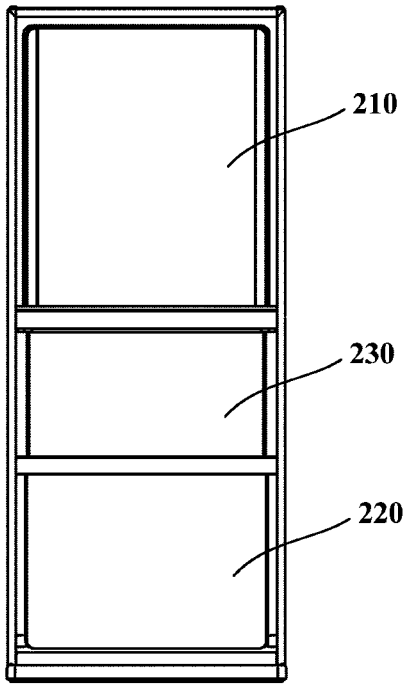
FIG. 12 is a schematic structural diagram of a refrigerator according to one embodiment of the present invention.
Figure 13:
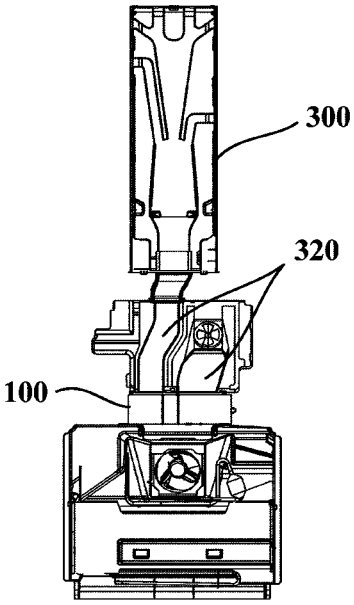
FIG. 13 is a schematic structural diagram of the branching air supply device in the refrigerator shown in FIG. 12 being mounted to an air duct assembly.

FIG. 12 is a schematic structural diagram of the refrigerator according to one embodiment of the present invention, and FIG. 13 is a schematic structural diagram of the branching air supply device 100 in the refrigerator shown in FIG. 12 that is mounted to the air duct assembly 300. As shown in FIGS. 12 and 13, the refrigerator of the embodiment of the present invention can comprise a refrigerating chamber 210 in an upper part, a freezing chamber 220 in a lower part, and a temperature-changing chamber 230 in a middle part. The air duct assembly 300 is used to send cold air flowing out of the cooling chamber to the refrigerating chamber 210 and the temperature-changing chamber 230. That is to say, the air duct assembly 300 can be provided with two branch air ducts 320, and the branching air supply device 100 is provided with two airflow passages 21 for controlling the flow rate of the airflow entering the refrigerating chamber 210 and the temperature-changing chamber 230. Further, the air duct assembly 300 can also be provided with an air supply duct for providing cold air to the freezing chamber 220.

Figure 14:
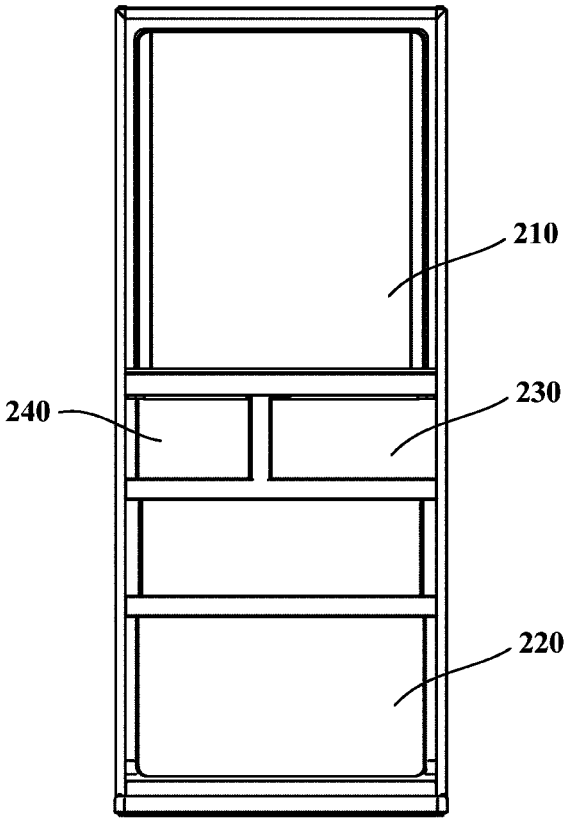
FIG. 14 is a schematic structural diagram of a refrigerator according to one embodiment of the present invention.
Figure 15:
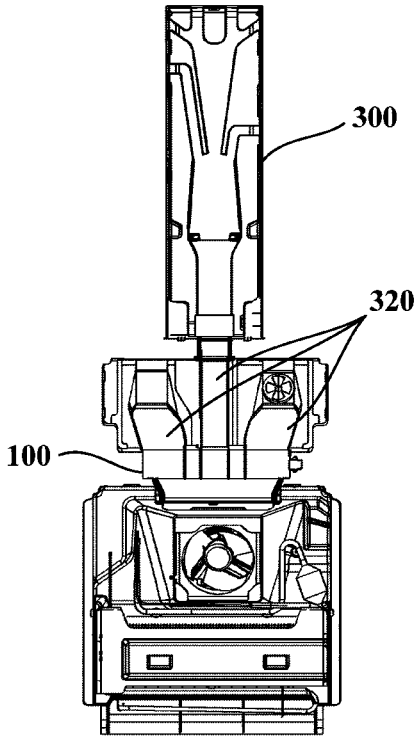
FIG. 15 is a schematic structural diagram of the branching air supply device in the refrigerator shown in FIG. 14 being mounted to the air duct assembly.

FIG. 14 is a schematic structural diagram of the refrigerator according to one embodiment of the present invention, and FIG. 15 is a schematic structural diagram of the branching air supply device 100 in the refrigerator shown in FIG. 14 that is mounted to the air duct assembly 300. As shown in FIGS. 14 and 15, the refrigerator of the embodiment of the present invention can comprise a refrigerating chamber 210 in an upper part, a freezing chamber 220 in a lower part, and a temperature-changing chamber 230 and an ice-making chamber 240 in a middle part. The air duct assembly 300 is used to send cold air flowing out of the cooling chamber to the refrigerating chamber 210, the temperature-changing chamber 230, and the ice-making chamber 240. That is to say, the air duct assembly 300 can be provided with three branch air ducts 320, and the branching air supply device 100 is provided with three airflow passages 21 for controlling the flow rate of the airflow entering the refrigerating chamber 210, the temperature-changing chamber 230, and the ice-making chamber 240. Further, the air duct assembly 300 can also be provided with an air supply duct for providing cold air to the freezing chamber 220. Particularly, the refrigerator can control the movement of the linkage device 40 according to the temperature detected by a temperature sensor in the refrigerator so as to achieve the corresponding control, such that cold air can be distributed reasonably to the plurality of storage compartments, thus increasing the freshness preservation performance and running efficiency of the refrigerator.

In some other embodiments of the present invention, the plurality of branch air ducts 320 of the air duct assembly 300 of the refrigerator are also configured such that air flowing out of the air duct assembly 300 enters the storage compartment from a plurality of positions on compartment walls of one storage compartment of the refrigerator, respectively.

Figure 16:
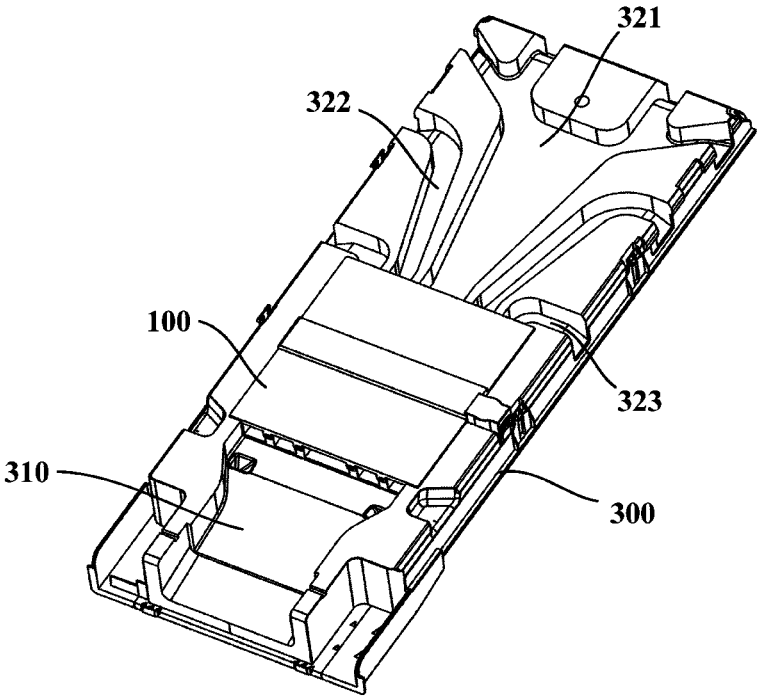
FIG. 16 is a schematic structural diagram of the branching air supply device being mounted to the air duct assembly according to one embodiment of the present invention.

FIG. 16 is a schematic structural diagram of the branching air supply device 100 being mounted to the air duct assembly 300 according to one embodiment of the present invention. In this embodiment, the refrigerator can comprise a refrigerating chamber 210 in an upper part, a freezing chamber 220 in a lower part, and a temperature-changing chamber 230 in a middle part. The air duct assembly 300 is used to send cold air flowing out of the cooling chamber to the refrigerating chamber 210. The air duct assembly 300 can be provided with three branch air ducts 320, which respectively send cold airflow to the upper part, the middle part and the lower part of the refrigerating chamber 210. Particularly, one branch air duct 320 for sending cold airflow to the upper part of the refrigerating chamber 210 is provided and can be referred to as a first branch air duct 321; two branch air ducts 320 for sending the cold airflow to the middle part of the refrigerating chamber 210 are provided and can be referred to as second branch air ducts 322, and the two second branch air ducts 322 are located on two sides of the first branch air duct 321; and two branch air ducts 320 for sending the cold airflow to the lower part of the refrigerating chamber 210 are provided and can be referred to as third branch air ducts 323 and are located on two sides of the two second branch air ducts 322 and the first branch air duct 321. That is to say, the air duct assembly 300 can be provided with five branch air ducts 320, and the branching air supply device 100 is provided with five airflow passages 21, which respectively are a first airflow passage, two second airflow passages located on two sides of the first airflow passage, and two outermost third airflow passages and are used to control the flow rate of the airflow entering the upper part, the middle part or the lower part of the refrigerating chamber 210. Further, two lateral sides of the first branch air duct 321 are both provided with cold air outlets to uniformly cool two sides of the upper part of the refrigerating chamber 210. One side of each of the second branch air ducts 322 is provided with a cold air outlet, and the linkage device 40 enables two baffle plates 30 located in the two second airflow passages to synchronously move so as to uniformly cool two lateral sides of the middle part of the refrigerating chamber 210. One side of each of the third branch air ducts 323 is provided with a cold air outlet, and the linkage device 40 enables two baffle plates 30 located in the two third airflow passages to synchronously move so as to uniformly cool two lateral sides of the lower part of the refrigerating chamber 210.

The refrigerator in this embodiment can control, according to whether the refrigerating capacity at various positions of the storage compartment of the refrigerator is sufficient, cold air to flow into the positions from the corresponding branch air duct 320, so that the cold air can be reasonably distributed to different positions of the storage compartment, thus increasing the freshness preservation performance and running efficiency of the refrigerator. The branching air supply device 100 can implement the regulation of the air amount of the branch air ducts 320, and if somewhere within the storage compartment of the refrigerator needs cold air, the branch air duct 320 in that place is opened and same is closed if there is no need for cold air. Thus, the constancy of the temperature within the refrigerator is controlled, optimal storage environment is provided for food within the refrigerator, nutrition loss of food is reduced, power consumption of the refrigerator is reduced, and energy is saved.

The embodiment of the present invention also provides a further refrigerator, which comprises an air duct assembly 300, and a branching air supply device 100 in any of the above-mentioned embodiments. An air supply passage is defined in the air duct assembly 300. The branching air supply device 100 can be provided in the air supply passage and is configured to regulate the flow rate of the air is flowing through the air supply passage. That is to say, the refrigerator can implement the regulation of the flow rate of the airflow in one air supply passage by the branching air supply device 100 in any of the above-mentioned embodiments, has a simple structure, and is convenient and accurate to regulate.

Up to this, a person skilled in the art should recognize that although a plurality of exemplary embodiments of the present invention have been shown and described in detail herein, numerous other variations or modifications meeting the principle of the present invention can be directly determined or derived according to the contents disclosed in the present invention without departing from the spirit and scope of the present invention. Therefore, the scope of the present invention should be construed and considered as covering all of such other variations or modifications.

What is claimed is:

1. A branching air supply device for a refrigerator, comprising:

a housing, with a plurality of airflow passages arranged in parallel being defined in the housing;

a plurality of baffle plates, each of the baffle plates being movably mounted to the housing and being configured to perform complete blocking, partial conducting or complete conducting of one of the airflow passages in different positions; and a linkage device movably mounted to the housing and configured to enable each of the baffle plates to move intermittently when the linkage device moves, in order to enable each of the baffle plates to move or keep still during the movement of the linkage device from one position to another, and to enable each of the baffle plates to move or keep still when the other, one or more of the baffle plates move, so that each of the baffle plates adjusts the flow rate of airflow in one of the airflow passages, wherein each of the baffle plates is rotatably mounted in one of the airflow passages, wherein the linkage device comprises a plurality of sliders synchronously moving in a direction parallel to the airflow passages; each of the sliders extends in the direction parallel to the airflow passages, and has a concave-convex surface extending in a bent manner in the direction parallel to the airflow passages, and wherein each of the baffle plates is in contact with the concave-convex surface of one of the sliders, such that when each of the sliders moves, under the curved surface change of the concave-convex surface of the slider, one of the baffle plates rotates intermittently or moves in the direction perpendicular to the airflow passages.

2. The branching air supply device according to claim 1, wherein the housing comprises a base, and a plurality of parallel-arranged air duct walls extending from one surface of the base, every two adjacent air duct walls that are closest to each other defining one of the airflow passages therebetween.

3. The branching air supply device according to claim 2, wherein the housing also comprises an air duct cover mounted to an end of the plurality of air duct walls that is away from the base; and each of the baffle plates is rotatably mounted to the air duct cover.

4. The branching air supply device according to claim 2, wherein the air duct wall on at least one side of each of the airflow passages is provided with a sliding groove extending in a lengthwise direction of the air duct wall and a guide slot extending in a thickness direction of the air duct wall, each of the sliding grooves having an opening which faces away from the base, and each of the guide slot communicating the sliding groove and the airflow passage, and each of the sliders is movably mounted into the sliding groove of one of the air duct walls; and each of the baffle plates comprises a convex column which is inserted into the guide slot of one of the air duct walls and is in contact with the concave-convex surface of the slider located in the sliding groove of the said air duct wall.

5. The branching air supply device according to claim 4, wherein each of the baffle plates also comprises a baffle plate portion and a connecting plate portion which extends from one surface of the baffle plate portion and is perpendicular to the baffle plate portion, and the convex column of each of the baffle plates protrudes from the connecting plate portion of the said baffle plate.

6. The branching air supply device according to claim 1, wherein the linkage device also comprises two linkage rods respectively fixed to two ends of the plurality of sliders such that the plurality of sliders synchronously move.

7. The branching air supply device according to claim 6, further comprising:

a rack extending in the direction parallel to the airflow passages and fixedly connected to or integrally formed with the outermost one of the sliders;

a gear meshing with the rack; and a driving device configured to drive the gear to rotate.

8. The branching air supply device according to claim 1, further comprising:

a plurality of elastic members, each of the elastic members being configured to urge one of the baffle plates to come into contact with and abut against the concave-convex surface of one of the sliders.

9. The branching air supply device according to claim 1, wherein each of the baffle plates, when in contact with a concave surface of the concave-convex surface, is configured to completely block one of the airflow passages; and each of the baffle plates, when in contact with a convex surface of the concave-convex surface, is configured to completely conduct air through one of the airflow passages.

10. The branching air supply device according to claim 9, wherein the plurality of airflow passages comprise a first airflow passage, two second airflow passages located on two sides of the first airflow passage, and two outermost third airflow passages; and the plurality of sliders comprise a first slider, two second sliders located on two sides of the first slider, and two outermost third sliders;

a concave-convex surface of the first slider is convex, concave, convex and concave in a flow direction of airflow in the airflow passages;

a concave-convex surface of each of the second sliders is concave, convex, concave and convex in the flow direction of airflow in the airflow passages; and a concave-convex surface of each of the third sliders is convex and concave in the flow direction of airflow in the airflow passages.

11. The branching air supply device according to claim 1, wherein the plurality of airflow passages are symmetrically arranged about a geometric symmetry plane, and the linkage device is configured to enable the baffle plates in every two of the airflow passages that are symmetrical about the geometric symmetry plane to synchronously move.

12. A refrigerator, comprising:

an air duct assembly with a main air supply duct and a plurality of branch air ducts being defined in the air duct assembly, wherein the plurality of branch air ducts are configured such that the airflow flowing out of the air duct assembly enters a plurality of storage compartments of the refrigerator, respectively, or the airflow flowing out of the air duct assembly enters the storage compartment from a plurality of positions on a compartment wall of one storage compartment of the refrigerator, respectively; and a branching air supply device according to claim 1 that is provided in the air duct assembly, inlets of a plurality of airflow passages of the branching air supply device being all in communication with the main air supply duct, and outlets of the plurality of airflow passages being respectively in communication with the plurality of branch air ducts.

13. A refrigerator, comprising:

an air duct assembly, with an air supply passage being defined in the air duct assembly; and a branching air supply device according to claim 1 that is provided in the air supply passage and configured to regulate the flow rate of the airflow flowing through the air supply passage.

* * * * *